US008714726B2

(12) United States Patent
Kondo et al.

(10) Patent No.: US 8,714,726 B2
(45) Date of Patent: May 6, 2014

(54) PRINTING APPARATUS, PRINTING METHOD, AND PROGRAM

(75) Inventors: Takamitsu Kondo, Shiojiri (JP); Toru Takahashi, Azumino (JP); Kazuyoshi Tanase, Matsumoto (JP); Hiroshi Wada, Azuminoa (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 13/426,343

(22) Filed: Mar. 21, 2012

(65) Prior Publication Data

US 2012/0242767 A1 Sep. 27, 2012

(30) Foreign Application Priority Data

Mar. 22, 2011 (JP) ..... 2011-063047

(51) Int. Cl.
*B41J 2/01* (2006.01)

(52) U.S. Cl.
USPC ..... 347/102

(58) Field of Classification Search
USPC ..... 347/6, 9, 15, 40–43, 101, 102
IPC ..... B41J 2/01
See application file for complete search history.

(56) References Cited

U.S. PATENT DOCUMENTS

| | | | | |
|---|---|---|---|---|
| 2007/0013759 | A1* | 1/2007 | Kadomatsu et al. | 347/102 |
| 2010/0141696 | A1* | 6/2010 | Fujisawa | 347/9 |
| 2010/0156971 | A1* | 6/2010 | Ikeda et al. | 347/9 |
| 2010/0194838 | A1* | 8/2010 | Mitsuzawa | 347/102 |

FOREIGN PATENT DOCUMENTS

JP 2000-158793 A 6/2000

* cited by examiner

*Primary Examiner* — Manish S Shah
*Assistant Examiner* — Roger W Pisha, II
(74) *Attorney, Agent, or Firm* — Maschoff Brennan

(57) ABSTRACT

A printing apparatus includes a nozzle that ejects, to a medium, photo-curing ink cured when irradiated with light, and an irradiation unit that irradiates, with the light, the photo-curing ink landed on the medium. Here, when printing an image on the medium by coating with the photo-curing ink, the photo-curing ink is ejected from the nozzle so that unevenness is formed in an original edge of the image by having a pixel that forms a dot along the edge and a pixel that does not form the dot appeared, and the photo-curing ink is cured by irradiating the image with the light from the irradiation unit.

6 Claims, 12 Drawing Sheets

FIG. 6

LINE WIDTH 8 mm

| | | | | | | | | | |
|---|---|---|---|---|---|---|---|---|---|
| CONVERSION WIDTH | 0 | 1 | 1 | 1 | 1 | 1 | 1 | 1 | 1 |
| CONVEX PORTION WIDTH | 0 | 1 | 1 | 1 | 1 | 2 | 2 | 2 | 2 |
| CONCAVE PORTION WIDTH | 0 | 1 | 2 | 3 | 4 | 1 | 2 | 3 | 4 |
| CONVERSION WIDTH | | 1 | 1 | 1 | 1 | 1 | 1 | 1 | 1 |
| CONVEX PORTION WIDTH | | 3 | 3 | 3 | 3 | 4 | 4 | 4 | 4 |
| CONCAVE PORTION WIDTH | | 1 | 2 | 3 | 4 | 1 | 2 | 3 | 4 |
| CONVERSION WIDTH | | 2 | 2 | 2 | 2 | 2 | 2 | 2 | 2 |
| CONVEX PORTION WIDTH | | 1 | 1 | 1 | 1 | 2 | 2 | 2 | 2 |
| CONCAVE PORTION WIDTH | | 1 | 2 | 3 | 4 | 1 | 2 | 3 | 4 |
| ⋮ | | | | | | | | | |
| CONVERSION WIDTH | | 4 | 4 | 4 | 4 | 4 | 4 | 4 | 4 |
| CONVEX PORTION WIDTH | | 3 | 3 | 3 | 3 | 4 | 4 | 4 | 4 |
| CONCAVE PORTION WIDTH | | 1 | 2 | 3 | 4 | 1 | 2 | 3 | 4 |

LINE WIDTH 6 mm

| | | | | | | | | | |
|---|---|---|---|---|---|---|---|---|---|
| CONVERSION WIDTH | 0 | 1 | 1 | 1 | 1 | 1 | 1 | 1 | 1 |
| CONVEX PORTION WIDTH | 0 | 1 | 1 | 1 | 1 | 2 | 2 | 2 | 2 |
| CONCAVE PORTION WIDTH | 0 | 1 | 2 | 3 | 4 | 1 | 2 | 3 | 4 |
| CONVERSION WIDTH | | 1 | 1 | 1 | 1 | 1 | 1 | 1 | 1 |
| CONVEX PORTION WIDTH | | 3 | 3 | 3 | 3 | 4 | 4 | 4 | 4 |
| CONCAVE PORTION WIDTH | | 1 | 2 | 3 | 4 | 1 | 2 | 3 | 4 |
| ⋮ | | | | | | | | | |

FIG. 9A

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |

FIG. 9B

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |

FIG. 9C

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |

FIG. 9D

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 1 | 0 | 1 | 0 | 1 | 0 | 1 | 0 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 0 | 1 | 0 | 1 | 0 | 1 | 0 | 1 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |

FIG. 10A

| | | | | | | | | | | | | | | |
|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 11 | 11 | 11 | 11 | 11 | 11 | 11 | 11 | 11 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |

00 NO DOT-FORMING

01 SMALL DOT

00 INTERMEDIATE DOT

00 LARGE DOT

FIG. 10B

| | | | | | | | | | | | | | | |
|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 01 | 00 | 01 | 00 | 01 | 00 | 01 | 00 | 01 | 00 | 00 | 00 |
| 00 | 00 | 01 | 11 | 11 | 11 | 11 | 11 | 11 | 11 | 11 | 11 | 01 | 00 | 00 |
| 00 | 00 | 00 | 11 | 11 | 11 | 11 | 11 | 11 | 11 | 11 | 11 | 00 | 00 | 00 |
| 00 | 00 | 01 | 11 | 11 | 11 | 11 | 11 | 11 | 11 | 11 | 11 | 01 | 00 | 00 |
| 00 | 00 | 00 | 11 | 11 | 11 | 11 | 11 | 11 | 11 | 11 | 11 | 00 | 00 | 00 |
| 00 | 00 | 01 | 11 | 11 | 11 | 11 | 11 | 11 | 11 | 11 | 11 | 01 | 00 | 00 |
| 00 | 00 | 00 | 11 | 11 | 11 | 11 | 11 | 11 | 11 | 11 | 11 | 00 | 00 | 00 |
| 00 | 00 | 01 | 11 | 11 | 11 | 11 | 11 | 11 | 11 | 11 | 11 | 01 | 00 | 00 |
| 00 | 00 | 00 | 11 | 11 | 11 | 11 | 11 | 11 | 11 | 11 | 11 | 00 | 00 | 00 |
| 00 | 00 | 01 | 11 | 11 | 11 | 11 | 11 | 11 | 11 | 11 | 11 | 01 | 00 | 00 |
| 00 | 00 | 00 | 01 | 00 | 01 | 00 | 01 | 00 | 01 | 00 | 01 | 00 | 00 | 00 |
| 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 |

00 NO DOT-FORMING

01 SMALL DOT

00 INTERMEDIATE DOT

00 LARGE DOT

FIG. 12A

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 255 | 255 | 255 | 255 | 255 | 255 | 255 | 255 | 255 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 |

0 WHITE

255 BLACK

FIG. 12B

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 63 | 63 | 63 | 63 | 63 | 63 | 63 | 63 | 63 | 63 | 63 | 63 | 63 | 0 |
| 0 | 63 | 127 | 127 | 127 | 127 | 127 | 127 | 127 | 127 | 127 | 127 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 255 | 255 | 255 | 255 | 255 | 255 | 255 | 255 | 255 | 127 | 63 | 0 |
| 0 | 63 | 127 | 127 | 127 | 127 | 127 | 127 | 127 | 127 | 127 | 127 | 127 | 63 | 0 |
| 0 | 63 | 63 | 63 | 63 | 63 | 63 | 63 | 63 | 63 | 63 | 63 | 63 | 63 | 0 |
| 0 | 0 | 0 | 0 | 0 | 0 | 0 | 0 | 0 | 0 | 0 | 0 | 0 | 0 | 0 |

0 WHITE

255 BLACK

FIG. 12C

| | | | | | | | | | | | | | | |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |
| 0 | 0 | 0 | 1 | 0 | 0 | 0 | 1 | 0 | 0 | 0 | 1 | 0 | 0 | 0 |
| 0 | 0 | 0 | 1 | 0 | 1 | 0 | 1 | 0 | 1 | 0 | 1 | 0 | 0 | 0 |
| 0 | 1 | 1 | 1 | 1 | 1 | 1 | 1 | 1 | 1 | 1 | 1 | 1 | 1 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 1 | 1 | 1 | 1 | 1 | 1 | 1 | 1 | 1 | 1 | 1 | 1 | 1 | 0 |
| 0 | 0 | 0 | 1 | 1 | 1 | 1 | 1 | 1 | 1 | 1 | 1 | 0 | 0 | 0 |
| 0 | 0 | 1 | 1 | 1 | 1 | 1 | 1 | 1 | 1 | 1 | 1 | 1 | 0 | 0 |
| 0 | 0 | 0 | 1 | 1 | 1 | 1 | 1 | 1 | 1 | 1 | 1 | 0 | 0 | 0 |
| 0 | 1 | 1 | 1 | 1 | 1 | 1 | 1 | 1 | 1 | 1 | 1 | 1 | 1 | 0 |
| 0 | 0 | 0 | 1 | 0 | 1 | 0 | 1 | 0 | 1 | 0 | 1 | 0 | 0 | 0 |
| 0 | 0 | 0 | 1 | 0 | 0 | 0 | 1 | 0 | 0 | 0 | 1 | 0 | 0 | 0 |
| 0 | 0 | 0 | 0 | 0 | 0 | 0 | 0 | 0 | 0 | 0 | 0 | 0 | 0 | 0 |

0 NO DOT-FORMING

1 DOT-FORMING

FIG. 13

CHARACTER SIZE
24 FONTS

CONVERSION WIDTH 0
CONVEX PORTION WIDTH 0
CONCAVE PORTION WIDTH 0

ABCDEFG •••

CONVERSION WIDTH 1
CONVEX PORTION WIDTH 1
CONCAVE PORTION WIDTH 1

ABCDEFG •••

CONVERSION WIDTH 1
CONVEX PORTION WIDTH 1
CONCAVE PORTION WIDTH 2

ABCDEFG •••

⋮

CHARACTER SIZE
36 FONTS

CONVERSION WIDTH 0
CONVEX PORTION WIDTH 0
CONCAVE PORTION WIDTH 0

ABCDE•••

CONVERSION WIDTH 1
CONVEX PORTION WIDTH 1
CONCAVE PORTION WIDTH 1

ABCDE•••

CONVERSION WIDTH 1
CONVEX PORTION WIDTH 1
CONCAVE PORTION WIDTH 2

ABCDE•••

⋮

PRINTING APPARATUS, PRINTING METHOD, AND PROGRAM

CROSS-REFERENCE TO RELATED APPLICATIONS

This application claims priority to Japanese Patent Application No. 2011-063047 filed on Mar. 22, 2011. The entire disclosure of Japanese Patent Application No. 2011-063047 is hereby incorporated herein by reference.

BACKGROUND

1. Technical Field

The present invention relates to a printing apparatus, a printing method, and a program.

2. Related Art

A printing apparatus which ejects photo-curing ink (for example, ultraviolet (UV) ink) cured by irradiation of light (for example, ultraviolet light (UV) and visible light, etc.) is known. In the printing apparatus, light is irradiated to the dots formed on a medium after ejecting UV ink from a nozzle to the medium. Thus, the dots are cured and then fixed on the medium (for example, see, JP-A-2000-158793).

Since the photo-curing ink hardly permeates the medium, dots constituting a print image are formed in relief when an image is printed using the photo-curing ink in comparison with when an image is printed using, for example, permeable ink (for example, aqueous ink).

In addition, the inventor of this application has found a phenomenon (the thick heap phenomenon) that a region close to edges of the print image is especially in relief in comparison with other parts thereof when an image is printed with the ink jet method using the photo-curing ink. Also, it has been found that, due to the thick heap phenomenon, the print image is visible three-dimensionally when the print image is visually perceived in a state in which light is specularly reflected only in a part of the print image, so that the print image is perceived thicker than it actually is, resulting in deterioration in image quality of the print image.

SUMMARY

An advantage of some aspects of the invention is to improve a printing apparatus, a printing method, and a program in which image quality of an image printed with the ink jet method using photo-curing ink.

According to an aspect of the invention, there is provided a printing apparatus, including: a nozzle that ejects, onto a medium, photo-curing ink cured when irradiated with light; and an irradiation unit that irradiates, with the light, the photo-curing ink landed on the medium, wherein, when printing an image on the medium by coating with the photo-curing ink, the photo-curing ink is ejected from the nozzle so that unevenness is formed in an original edge of the image by having a pixel that forms a dot along the edge and a pixel that does not form the dot appeared, and the photo-curing ink is cured by irradiating the image with the light from the irradiation unit.

BRIEF DESCRIPTION OF THE DRAWINGS

The invention will be described with reference to the accompanying drawings, wherein like numbers reference like elements.

FIG. 3A is an explanatory diagram of a filled image on image data after performing a roughening process so as to suppress thick heap perception, FIG. 3B is an explanatory diagram of image data (pixel data) of a region indicated by a dotted line of FIG. 3A, and FIG. 3C is an explanatory diagram of a dot position and a ridge shape.

FIG. 6 is an explanatory diagram of a test pattern.

FIGS. 9A to 9D are explanatory diagrams of image data when a roughening process is performed.

FIGS. 10A and 10B are explanatory diagrams of image data when another roughening process is performed.

FIGS. 12A to 12C are explanatory diagrams of image data when a roughening process is performed before a halftone process.

FIG. 13 is an explanatory diagram of another test pattern.

DESCRIPTION OF EXEMPLARY EMBODIMENTS

Figure 1A:
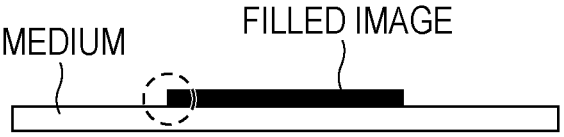
FIG. 1A is an explanatory diagram of a print image obtained when an image is printed on a medium using UV ink.

Hereinafter, exemplary embodiments of the invention will now be described in detail with reference to the accompanying drawings.

A printing apparatus includes a nozzle that ejects, onto a medium, photo-curing ink cured when irradiated with light, and an irradiation unit that irradiates, with the light, the photo-curing ink landed on the medium. Here, when printing an image on the medium by coating with the photo-curing ink, the photo-curing ink is ejected from the nozzle so that unevenness is formed in an original edge of the image by having a pixel that forms a dot along the edge and a pixel that does not form the dot appeared, and the photo-curing ink is cured by irradiating the image with the light from the irradiation unit.

According to the printing apparatus, a "thick heap perception" of an image that is printed in an ink jet method using the photo-curing ink may be suppressed.

It is preferable that a shape of the unevenness be determined in accordance with the line width of the image. Since the "thick heap phenomenon" differs in accordance with the line width, an appropriate shape of the unevenness differs in accordance with the line width.

It is preferable that the unevenness be formed so that a dot density is increased toward the image. Thus, the "thick heap perception" may be more suppressed.

It is preferable that a test pattern be printed on the medium, and the shape of the unevenness be determined in accordance with an inspection result of the test pattern. Thus, an appropriate shape of the unevenness suitable for suppressing the "thick heap perception" may be determined.

It is preferable that the image be printed on the medium that does not have an ink receiving layer. When an image is printed using the photo-curing ink in the ink jet method, a non-ink absorbing medium is particularly effective.

In a printing method uses a nozzle that ejects, to a medium, photo-curing ink cured when irradiated with light, and an irradiation unit that irradiates, with the light, the photo-curing ink landed on the medium. Here, the printing method includes ejecting the photo-curing ink from the nozzle when printing an original image on the medium by coating with the photo-curing ink, so that unevenness is formed in an edge of the image by having a pixel that forms a dot along the edge and a pixel that does not form the dot appeared, and curing the photo-curing ink by irradiating the image with the light from the irradiation unit.

According to the printing apparatus, the "thick heap perception" of an image that is printed in an ink jet method using the photo-curing ink may be suppressed.

In a printing apparatus including a nozzle that ejects, onto a medium, photo-curing ink cured when irradiated with light, and an irradiation unit that irradiates, with the light, the photo-curing ink landed on the medium, a program includes a function of ejecting the photo-curing ink from the nozzle so that unevenness is formed in an original edge of the image by having a pixel that forms a dot along the edge and a pixel that does not form the dot appeared, and a function of curing the photo-curing ink by irradiating the image with the light from the irradiation unit.

According to this program, image quality of an image that is printed with the ink jet method using the photo-curing ink may be improved.

Overview

Thick Heap Phenomenon and Thick Heap Perception

Since a medium such as a plastic film, and the like has the property that the medium hardly absorbs ink, UV ink may be used as the photo-curing ink when performing printing on the medium in the ink jet method. The UV ink is ink having the property that the UV ink is cured when ultraviolet rays are irradiated. Dots are formed by curing the UV ink, so that printing may be performed even on the medium which does not have the ink receiving layer and ink absorbing property.

However, the dot formed of the UV ink is in relief on the surface of the medium, so that unevenness is formed on the surface of the medium when a print image is formed on the medium using the UV ink. When the print image is a filled image, the print image has a thickness.

FIG. 1A is an explanatory diagram of a print image obtained when an image is printed on a medium using UV ink.

Since the UV ink hardly permeates the medium, dots are formed in relief when an image is printed using the UV ink. When an image (the filled image) is printed, the dots formed of the UV ink fill a predetermined region, so that the print image having the thickness is formed on the medium. For example, when characters are printed on the medium, a character image (an example of the filled image) having the thickness is formed on the medium. The thickness of the print image printed using the UV ink is about several μm.

Figure 1B:
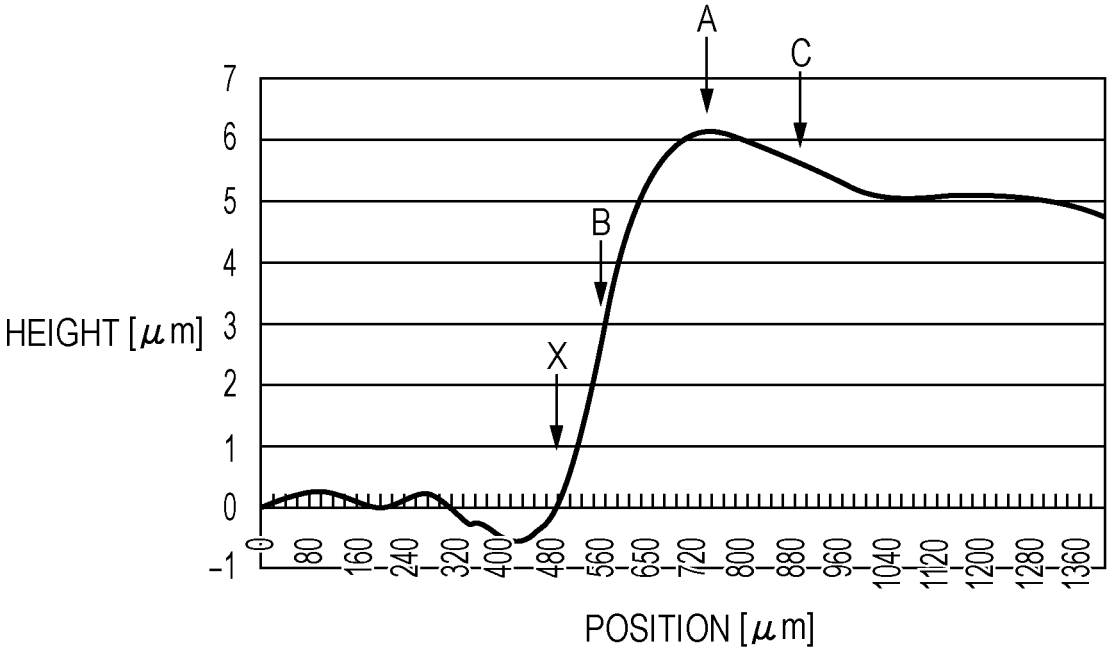
FIG. 1B is a graph illustrating measurement values of the thickness of a region (near the edge) indicated by the dotted line of FIG. 1A.

FIG. 1B is a graph illustrating a measurement value of a thickness of a region (near the edge) indicated by a dotted line in FIG. 1A. A horizontal axis of the graph indicates the position of the medium, and a vertical axis thereof indicates the height of the dots (the thickness of the print image). Also, the print image is an image that is painted out at a printing resolution of 720×720 dpi by forming a dot with a weight of the ink of 10 ng. The thickness of the print image was measured using a Quick Vision Stream plus, that is, a non-stop CNC image measuring machine manufactured by Mitsutoyo Corporation. As shown in the figure, the print image has a thickness of about 5 μm.

A position X in the graph indicates an outermost position of the print image. That is, the position X indicates the position of the edge (border) of the print image. In addition, a position A indicates the thickest position (the highest position) in the vicinity of the edge of the print image. In other words, the position A indicates a position of a relief portion in the vicinity of the edge of the print image.

The position A is located in an inner side from the position X by about 200 μm. In a region (a region B in the graph) between the position X and the position A, the print image is inclined to become progressively thicker toward the inside of the print image. Scales in the vertical and horizontal directions in the graph do not match; however, the inclination in the region B of the graph is actually at an angle of less than 3 degrees. In addition, in the region (the region C in the graph) of the print image inside relative to the position A, the print image gradually becomes thinner toward the inside, and when the thickness reaches about 5 μm, the thickness becomes almost uniform.

In the present specification, as in the position A in the graph, a phenomenon in which the region close to the edge is especially in relief in comparison with other parts is referred to as a "thick heap phenomenon". The "thick heap phenomenon" is a unique phenomenon occurring when an image is printed in the ink jet method using the UV ink.

A mechanism in which the "thick heap phenomenon" occurs is not clear; however, is considered roughly as follows. The UV ink has a higher viscosity than that of permeable ink; however, has liquidity enough to be ejected from the nozzle in the ink jet method (in this manner, the point in which the liquidity enough to be ejected from the nozzle is required is a unique characteristic different from ink that is used in a plate making printing). The UV ink has liquidity until the UV ink is completely cured by irradiating the UV ink with ultraviolet rays even after being landed on the medium. It is considered that the "thick heap phenomenon" occurs in the region close to the edge of the print image due to the effect of the liquidity after being landed.

Figure 2A:
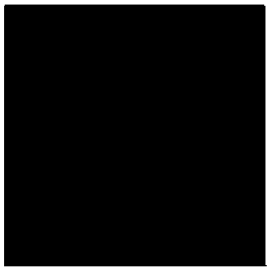
FIG. 2A is a diagram illustrating the print image of FIG. 1A viewed from above.
Figure 2B:
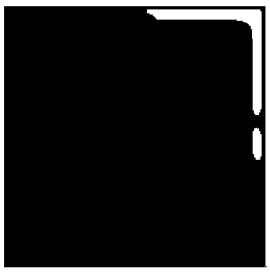
FIG. 2B is an explanatory diagram of a state in which light is specularly reflected in a part of the print image of FIG. 2A.

FIG. 2A is a top diagram illustrating the print image of FIG. 1A viewed from the above, and FIG. 2B is a view describing a state in which light is specularly reflected in a part of the print image of FIG. 2A. In FIG. 2B, a part which is shiny and visually perceived inside the print image is indicated with white.

At the center portion of the print image, the thickness is almost uniform, thereby obtaining uniform gloss. However, in the region close to the edge of the print image, the thickness is not uniform, thereby failing to obtain the uniform gloss.

The print image does not have the uniform thickness due to the "thick heap phenomenon" in the region close to the edge, so that a relief portion is formed inside relative to the edge (border) of the print image due to the edge. As a result, it can be confirmed visually that a part of the print image is shiny and visually perceived along the edge depending on the reflection angle of light as shown in FIG. 2B. From an observer's eye, a light source, depending on the light source, and the positional relationship and angle of the print image, light specularly reflected from the inclined region of FIG. 1B enters the observer's eye, and the print image is visually perceived as shown in FIG. 2B.

As shown in FIG. 2B, when a part of the print image is seen shining along the edge, the entire print image is perceived three-dimensionally. To give a comparative example, when the brightness of a part of a three-dimensional object is displayed to be brightly on a two-dimensional image on a display in computer graphics (for example, such as when the three-dimensional object is rendered as a two-dimensional image by ray tracing), the print image is perceived three-dimensionally. As a result, despite the fact that the print image has a thickness of about 5 μm, an observer of the print image may perceive the print image as being thicker.

In this specification, the phenomenon by which the print image is perceived as being thicker than the actual thickness of the print image due to the "thick heap phenomenon" is referred to as a "thick heap perception". The problem of the "thick heap perception" is a unique problem occurring when an image is printed with an ink jet method using UV ink.

In addition, the print image of a typical plate making printing (flexographic printing, offset printing, or the like) has little thickness in comparison with an image printed using the UV ink. Therefore, in the print image by the typical plate making printing, the "thick heap phenomenon" does not occur, and the problem of the "thick heap perception" does not arise. Also, a print image printed in a manner such that ink permeates the medium has little thickness. Therefore, the "thick heap phenomenon" does not occur even in the print image printed in a manner such that the ink permeates the medium, and the problem of the "thick heap perception" does not arise. Thus, the "thick heap phenomenon" or the "thick heap perception" is a unique phenomenon and a problem occurring when the image is printed with the ink jet method using the UV ink.

Overview of the Present Embodiment

As shown in FIG. 2B, the part in which the print image is shining is formed along the edge, so that the "thick heap perception" is generated. Therefore, the "thick heap perception" may be suppressed by distorting the shining part.

In addition, a phenomenon that the part in which the print image is shining is formed along the edge may occur because a ridge line of the thickest portion due to a "thick heap phenomenon" is formed straight along the edge. Therefore, in order to distort the shining part, the ridge line of the thickest portion due to the "thick heap phenomenon" may be formed in a rippling shape.

Thus, in the present embodiment, fine unevenness is formed in the edge of the image, so that, even though a part close to the edge of the print image is shining, the "thick heap perception" may be suppressed by distorting the shining part.

Figure 3A:
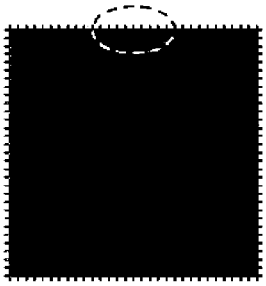
FIGS. 3A to 3C are explanatory diagrams of overviews according to an embodiment of the present invention. Here.
Figure 3B:
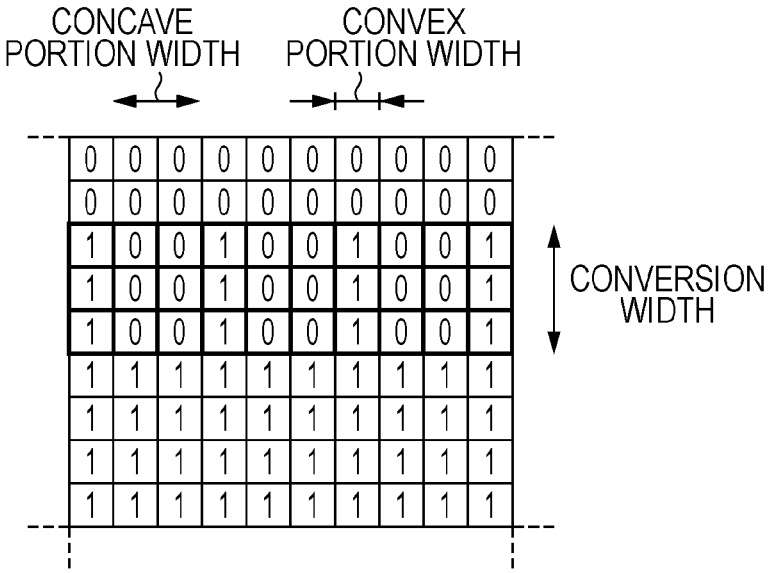
Figure 3C:
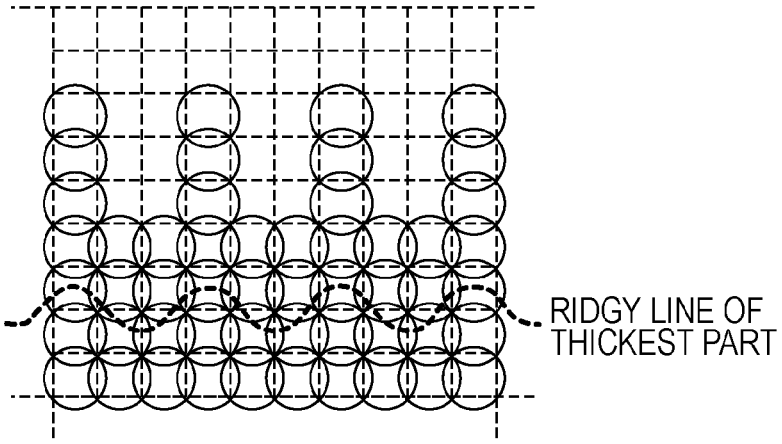

FIGS. 3A to 3C are explanatory diagrams of overviews according to an embodiment of the present invention. Here, FIG. 3A is an explanatory diagram of an image on image data after performing a "roughening process" so as to suppress the "thick heap perception", FIG. 3B is an explanatory diagram of image data (pixel data) of a region indicated by a dotted line of FIG. 3A, and FIG. 3C is an explanatory diagram of a dot position and a ridge shape.

In the present embodiment, by forming the fine unevenness in an original edge of an image, the "thick heap perception" may be suppressed. By alternately having a pixel that forms a dot and a pixel that doest not form the dot along the original edge of the image, the fine unevenness is formed in the edge. In the following description, a "roughening process" is referred to as a process that forms a dot so as to form the fine unevenness in the original edge of the image, or a process that processes image data so that the dot is formed as described above. The "roughening process" may be a dot reduction process that does not form a dot in a pixel in which the dot is originally formed, and a dot addition process that forms a dot in a pixel in which the dot is not originally formed.

In FIG. 3B, a conversion target region in which pixel data is converted by the "roughening process" is indicated by a thick frame. Here, it is assumed that a width of the conversion target region (conversion width) is 3 pixels, a width of a convex portion (convex portion width) is 1 pixel, and a width of a concave portion (concave portion width) is 2 pixels. A shape of the unevenness is mainly determined by the conversion width, the convex portion width, and the concave portion width. However, the shape of the unevenness may be determined by other factors. Each of the conversion width, the convex portion width, and the concave portion width are determined to have an appropriate value by an inspection process, which will be described later.

In FIG. 3C, since a dot is not formed in a region of the concave portion, a gap is formed while UV ink is not coated; however, actually, the UV ink gets wet and spreads on the medium after landed on the medium, so that the width of the concave portion becomes narrower. Thus, even though the unevenness is large on the image data as shown in FIG. 3A, the unevenness is relaxed on a filled image that is actually printed on the medium.

In FIG. 3C, a ridge line that connects the thickest portion generated due to the "thick heap phenomenon" is indicated by a dotted line. By the "roughening process" of the present embodiment, the ridge line is formed like rippling. As a result, even though a part of the region close to the edge of the print image is shining, the shining part is distorted, so that the "thick heap perception" may be suppressed.

Basic Configuration

First, a basic configuration of a printing apparatus for implementing the "roughening process" will be described. In addition, the "printing apparatus" of the present embodiment is a device for printing, on a medium, an image in which the "roughening process" has been performed. For example, a device (system) including a printer 1 which will be described below, and a computer 110 in which a printer driver is installed corresponds to the printing apparatus. A controller 10 of the printer 1 and the computer 110 constitute a control unit for controlling the printing apparatus.

Printer 1

Figure 4:
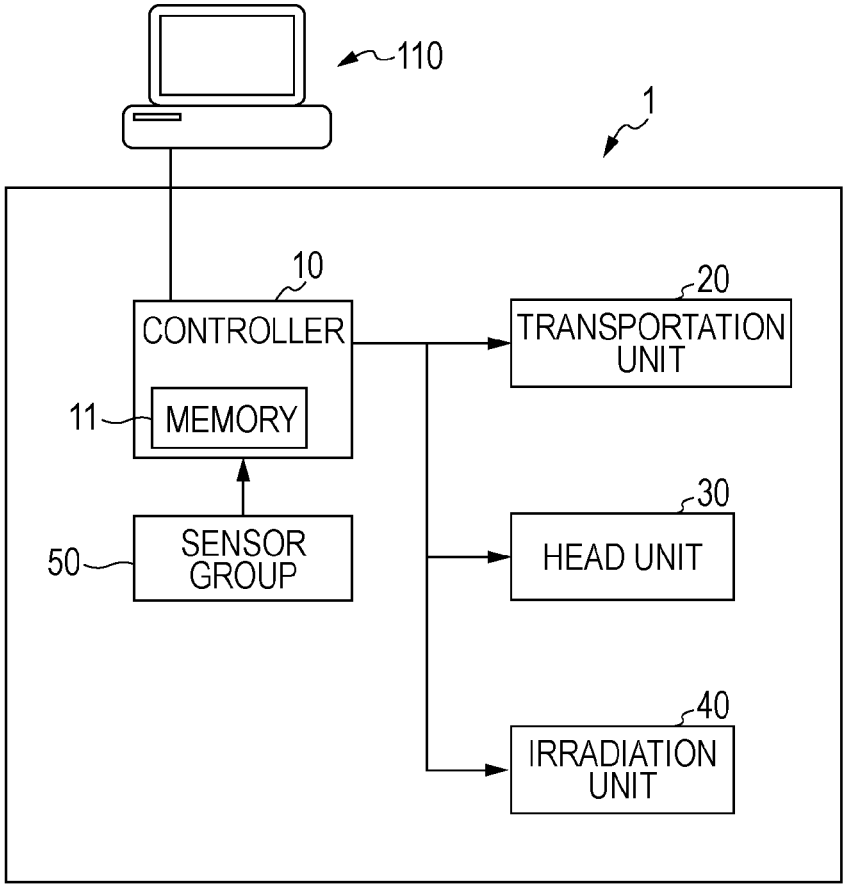
FIG. 4 is a block diagram illustrating an overall configuration of a printer.
Figure 5:
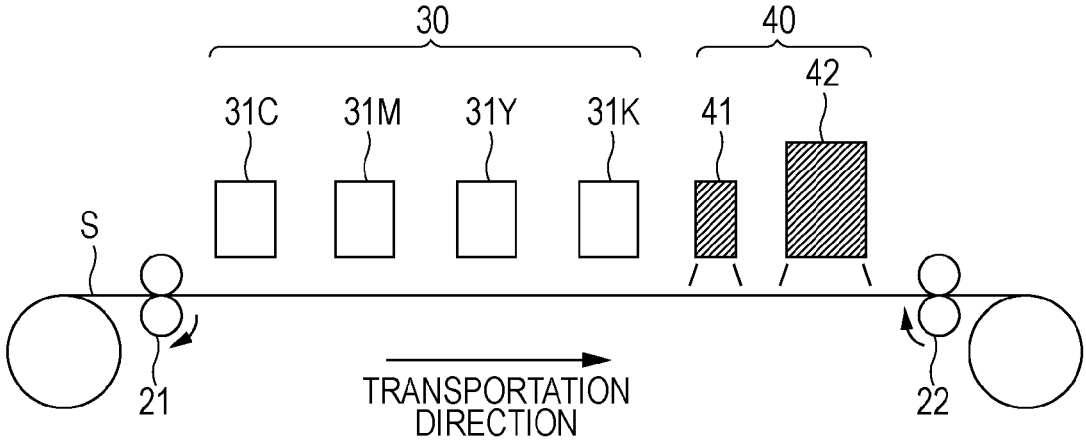
FIG. 5 is an explanatory diagram of an overall configuration of a printer.

FIG. 4 is a block diagram illustrating an overall configuration of a printer 1, and FIG. 5 is an explanatory diagram of an overall configuration of the printer 1. The printer 1 of the present embodiment is a so-called line printer. However, the printer 1 may be a serial printer (a printer in which a head is mounted in a carriage movable in a paper width direction) which is different from the line printer.

The printer 1 includes the controller 10, a transportation unit 20, a head unit 30, an irradiation unit 40, and a sensor group 50. The printer 1 that receives print data from the computer 110 that is a print control device controls each unit (the transportation unit 20, the head unit 30, the irradiation unit 40, and the like) by the controller 10.

The controller 10 is a control device for performing control of the printer 1. The controller 10 controls each unit in accordance with a program stored in a memory 11. In addition, the controller 10 controls each unit based on the print data received from the computer 110, and prints an image on a medium S. A variety of detection signals that are detected by the sensor group 50 are input to the controller 10.

The transportation unit 20 is used for transporting the medium S (for example, paper, film, and the like) in a transportation direction. The transportation unit 20 includes a transportation motor (not shown), an upstream side roller 21, and a downstream side roller 22. When the transportation motor which is not shown is rotated, the upstream side roller 21 and the downstream side roller 22 are rotated, and the roller-shaped medium S is transported in the transportation direction.

The head unit 30 is used for ejecting ink onto the medium S. The head unit 30 includes a cyan head group 31C for ejecting cyan ink, a magenta head group 31M for ejecting magenta ink, a yellow head group 31Y for ejecting yellow ink, and a black head group 31K for ejecting black ink. Each of the head groups includes a plurality of heads arranged in the paper width direction (a direction vertical to a paper surface in FIG. 5), and each of the heads includes a plurality of nozzles arranged in the paper width direction. Thus, each head group may form, at one time, dots across the full paper width. When ink is ejected from the head unit 30 toward the medium S which is transported in the transportation direction, a two-dimensional print image is formed on a printing surface of the medium S.

In the present embodiment, UV ink is ejected from each nozzle of the head unit 30. The UV ink is ink having a property of being cured when irradiated with ultraviolet rays. In addition, the UV ink has a property of having a high viscosity in comparison with permeable ink for performing printing by permeating the ink into the medium. For this reason, even when printing is performed on, for example, plain paper, the UV ink is hardly absorbed into the medium in comparison with the permeable ink. Since the UV ink cures dots and settles the cured dots on the medium, printing may be performed even though the medium does not have, for example, an ink receiving layer or ink absorbency.

The irradiation unit 40 is used to irradiate the UV ink ejected to the medium S with ultraviolet rays. The irradiation unit 40 has an initial curing irradiation unit 41 and a main curing irradiation unit 42.

The initial curing irradiation unit 41 is provided in a downstream side in a transportation direction of a print region (downstream side in a transportation direction of the head unit 30). The initial curing irradiation unit 41 irradiates with ultraviolet rays having intensity capable of curing (initial curing) the surface of the UV ink so that the UV ink ejected onto the medium S is not blurred. For example, as the initial curing irradiation unit 41, an LED (Light Emitting Diode), or the like may be adopted.

Further, in the present embodiment, a single initial curing irradiation unit is provided in the downstream side in the transportation direction of the head unit 30; however, the initial curing irradiation unit may be provided in the downstream side in the transportation direction of each of the four head groups.

The main curing irradiation unit 42 is provided in a downstream side in a transportation direction of the initial curing irradiation unit 41. The main curing irradiation unit 42 irradiates with ultraviolet rays having intensity capable of completely curing (completely curing) the UV ink on the medium. For example, as the main curing irradiation unit 42, a UV lamp, and the like is adopted.

When performing printing, the controller 10 transports the medium S to the transportation unit 20 in the transportation direction. The controller 10 forms dots on the medium by ejecting the UV ink to the head unit 30 while transporting the medium S, cures the dots formed of the UV ink by irradiating with the ultraviolet rays from the initial curing irradiation unit 41, and completely cures the dots by irradiating with the ultraviolet rays from the main curing irradiation unit 42.

The computer 110 is communicably connected with the printer 1, and outputs print data to the printer 1 corresponding to an image to be printed so as to have the printer 1 print the image.

In the computer 110, a printer driver is installed. The printer driver is a program for converting image data output from an application program into print data. The printer driver is recorded on a recording medium (computer-readable recording medium) such as CD-ROM, or the like. The printer driver may be downloaded to the computer 110 via the Internet.

Roughening Process

Inspection Process

Before performing the "roughening process", it is necessary that a conversion width, a convex portion width, and a concave portion width (see, FIG. 3C) are determined in advance. Therefore, test patterns in which the conversion width, the convex portion width, and the concave portion width are mutually different are printed to the printer 1. By selecting the test pattern having optimized image quality from the test patterns, the conversion width, the convex portion width, and the concave portion width suitable for the "roughening process" are determined.

FIG. 6 is an explanatory diagram of a test pattern. The printer 1 prints a plurality of test patterns shown in FIG. 6 on a medium.

Each of the plurality of test patterns includes a rectangular pattern and a display of a conversion width, a convex portion width, and a concave portion width. Although not shown, the rectangular pattern is subjected to a "roughening process". The conversion width, the convex portion width, and the concave portion width of the "roughening process" with respect to the rectangular pattern are the numbers displayed under the respective rectangular patterns as are.

The rectangular pattern in an upper left side of FIG. 6 (a rectangular pattern in which the conversion width, the convex portion width, and the concave portion width are zero) corresponds to a case in which a filled image is printed as is. Consequently, the rectangular pattern in the upper left side is a print image on which a "roughening process" is not performed. Typically, the "thick heap phenomenon" occurs in the rectangular pattern in the upper left side, and the rectangular pattern in the upper left side is perceived as being thicker than the actual thickness thereof.

In the rectangular patterns other than the rectangular pattern in the upper left side of FIG. 6, each of the conversion width, the convex portion width, and the concave portion width is changed in a range of 1 to 4 pixels. However, the range of the changes is not limited thereto, and another range may be possible. In addition, the conversion width, the convex portion width, and the concave portion width may be changed in mutually different ranges which is not the same range (for example, the conversion width is 1 to 4 pixels, the convex portion width is 1 to 6 pixels, and the concave portion width is 1 to 8 pixels).

When the conversion width is significantly narrow, there is the risk that the effect of the "roughening process" may not be obtained. In this case, a gloss along an edge inside the rectangular pattern is visually perceived, so that there is the risk that the "thick heap perception" remains. It cannot be said that the conversion width in the rectangular pattern in which the "thick heap perception" remains is optimized. Meanwhile, when the conversion width is significantly wide, the unevenness of the rectangular pattern becomes large although not shown, so that the unevenness is visually perceived, or the edge of the rectangular pattern is blurred to be visually perceived. Since the conversion width may suppress, for example, the "thick heap perception"; however, reduce image quality, it cannot be said that the conversion width is optimized. From this reason, a plurality of test patterns in which the conversion width is respectively changed is provided.

In addition, when the convex portion width and the concave portion width are significantly narrow, there is the risk that the effect of an abrupt process may not be obtained. In this case, a gloss along an edge inside the rectangular pattern is visually perceived, so that there is the risk that the "thick heap perception" remains. It cannot be said that the convex portion width and the concave portion width in the rectangular pattern in which the "thick heap perception" remains are optimized. Meanwhile, when the convex portion width and the concave portion width are significantly wide, the unevenness of the rectangular pattern becomes large although not shown, so that the unevenness may be visually perceived. Since the convex portion width and the concave portion width may suppress, for example, the "thick heap perception"; however, reduce image quality, it cannot be said that convex portion width and the concave portion width are optimized. From this reason, a plurality of test patterns in which the convex portion width and the concave portion width are respectively changed are provided.

In addition, test patterns having different line widths are respectively formed. For example, the test pattern in an upper side of FIG. 6 is a test pattern of 8 mm square; however, a rectangular pattern of 6 mm square is also formed in a lower side of FIG. 6. This is because an optimized number of the conversion width, the convex portion width, and the concave portion width may be considered to be different in accordance with the line width. For example, it is considered that since the amount of the ink coated on the medium is small when the line width is narrow, the "thick heap phenomenon" is reduced in comparison with when the line width is thick, thereby, for example, narrowing the conversion width. For this reason, a plurality of test patterns in which the line width is different is provided.

An inspector selects the rectangular pattern in which the "thick heap perception" is not generated and the unevenness in the outside can not be visually perceived, by observing the respective rectangular patterns. That is, the inspector selects an optimized rectangular pattern by observing both "the gloss" and "the color" of the rectangular pattern. When the test patterns having a plurality of line widths exist, the inspector selects the optimized rectangular pattern for each line width. Next, the inspector inputs, to the computer 110, the conversion width, the convex portion width, and the concave portion width corresponding to the selected test pattern to thereby store the input information in a storage device of the computer 110 or the memory 11 of the printer 1.

By the inspection process described as above, a table that associates the line width with each of the conversion width, the convex portion width, and the concave portion width is stored in the storage device of the computer 110 or the memory 11 of the printer 1. When the "thick heap phenomenon" is different due to different mediums, the table may be additionally provided for each medium.

In addition, a method of selecting the optimized test pattern is not limited to a sensory test carried out by the inspector.

For example, specular reflection light is detected from the rectangular pattern, and a shape of a region in which the specular reflection light is detected may be measured. That is, the rectangular pattern in which the "thick heap perception" is not generated may be selected based on a measurement result of a shape of a white region of FIG. 2B. In this case, as the unevenness of the region in which the specular reflection light is detected is larger, the rectangular pattern having the unevenness is evaluated to be the rectangular pattern without the "thick heap perception". In addition, an image of the rectangular pattern is read by a scanner, and the like, separately from the detection of the specular reflection light to perform an image analysis, so that a shape of an unevenness of a perimeter of the rectangular pattern may be measured. In this case, as the unevenness is smaller, the rectangular pattern having the unevenness may be evaluated to be the rectangular pattern having excellent image quality.

In addition, a three-dimensional shape of the rectangular pattern may be detected, and an optimized test pattern may be selected based on the detection result. When measuring the three-dimensional shape of the rectangular pattern, Quick Vision Stream plus, that is, a non-stop CNC image measuring machine manufactured by Mitsutoyo Corporation, which is used in the measurement of FIG. 1B may be used. When selecting the test pattern in which the unevenness of the ridge line is large from among the respective measurement results of the plurality of rectangular patterns, the rectangular pattern without the "thick heap perception" may be selected.

The above described inspection process may be performed in a manufacturing plant of the printer 1, or by a user of the printer 1.

Printing Process

When printing of an image drawn on an application program is directed by the user of the printer 1, the printer driver of the computer 110 starts. The printer driver receives image data from the application program, converts the received image data into print data having a format that can be interpreted by the printer 1, and outputs the print data to the printer. When converting the image data from the application program into the print data, the printer driver performs a resolution conversion process, a color conversion process, a halftone process, and the like. In addition, the printer driver of the present embodiment performs the above described "roughening process".

Figure 7:
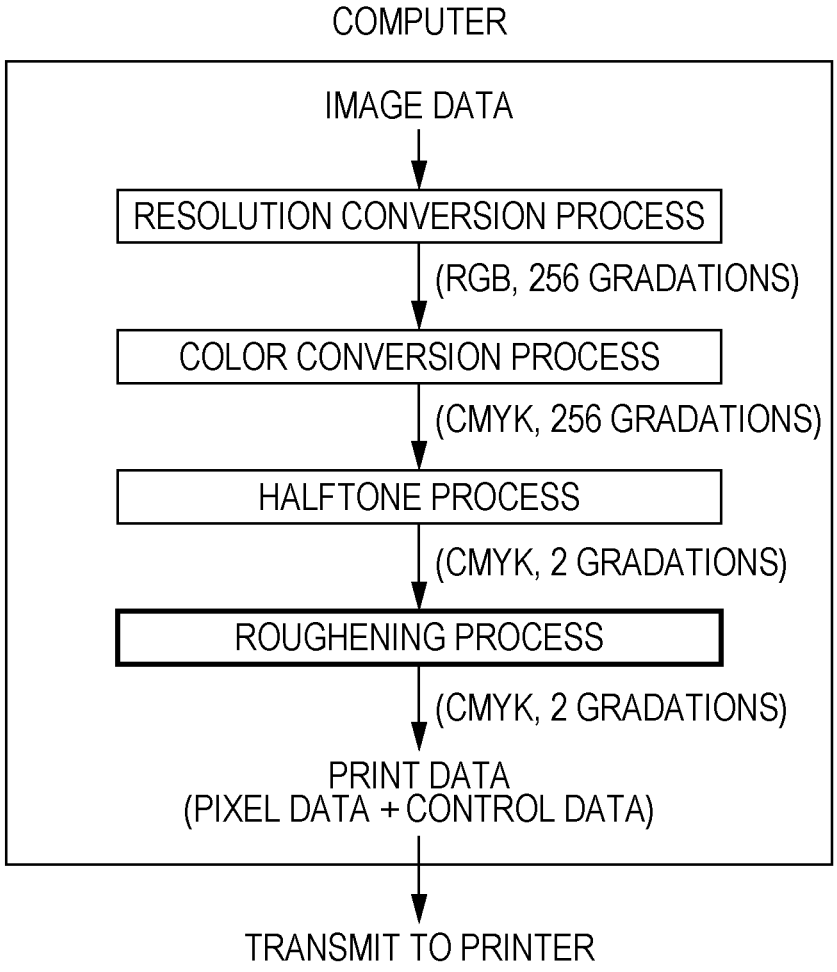
FIG. 7 is an explanatory diagram of a function of a printer driver of a computer.

FIG. 7 is an explanatory diagram of a function of a printer driver of a computer 110.

The resolution conversion process is a processing that converts image data (text data, image data, and the like) output from the application program to image data having a resolution (print resolution) printed on the medium. For example, when the printing resolution is 720×720 dpi, the image data of a vector format that is received from the application program is converted into image data of a bitmap format having a resolution of 720×720 dpi. Each pixel data of the image data obtained after performing the resolution conversion process is RGB data of multi-gradation (for example, 256 gradations) indicated by an RGB color space.

The color conversion process is a process that converts the RGB data into CMYK data displayed in CMYK color space. In addition, the CMYK data is data corresponding to a color of ink of the printer. The color conversion process is performed based on a table (color conversion lookup table LUT) that associates a gradation value of the RGB data with a gradation value of the CMYK data. In addition, pixel data obtained after performing the color conversion process is CMYK data of 256 gradations indicated by the CMYK color space.

The halftone process is a process that converts data of the high number of gradations into data of the number of gradations that can be formed by the printer. For example, data indicating 256 gradations by the halftone process is converted into 1-bit data indicating 2 gradations. Pixel data of 1-bit corresponds to, for each pixel, the image data obtained after performing the halftone process. The pixel data of 1-bit becomes data indicating presence and absence of a dot. In addition, when the pixel data is 2-bit data, the pixel data may indicate a size of the dot as well as the presence and absence of the dot. In any case, the pixel data obtained after performing the halftone process becomes data indicating a dot to be formed on the medium.

As shown in FIG. 3B, the "roughening process" is a process that processes image data so that fine unevenness is formed in an original edge of an image. Here, pixel data is processed so that a dot is formed in a pixel which does not originally form a dot.

Figure 8:
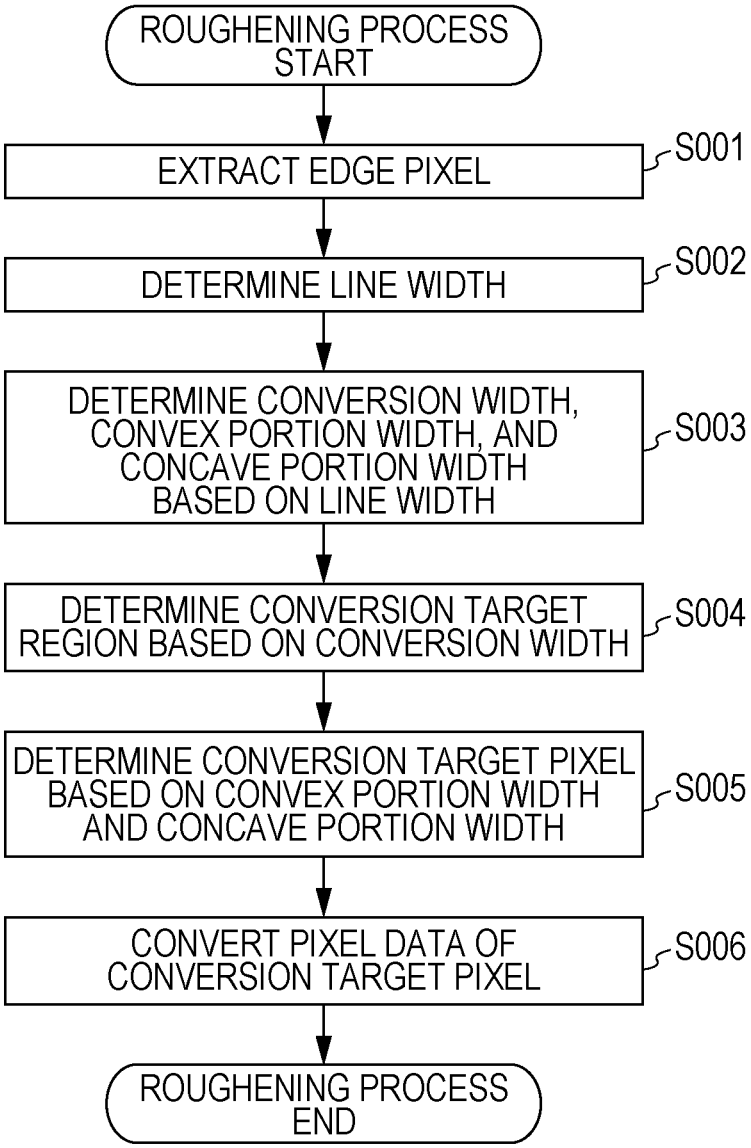
FIG. 8 is a flowchart illustrating a roughening process of FIG. 7.

FIG. 8 is a flowchart illustrating a "roughening process" of FIG. 7, and FIGS. 9A to 9D are explanatory diagrams of image data. FIG. 9A is an explanatory diagram of image data obtained after performing a halftone process. Here, it is assumed that pixel data of 1 bit is associated with each pixel. In addition, it is assumed that a filled image of 9×9 pixels is included in the image data. Here, only image data of a black color will be described; however, image data of other colors is subjected to the same process.

The printer driver performs an edge extraction process with respect to image data (see, FIG. 9A) obtained after performing the halftone process to thereby extract edge pixels located in a border of the image (see, S001 of FIG. 8). Here, pixels indicated by a thick frame of FIG. 9B are extracted as the edge pixels.

Next, the printer driver determines the line width of the image based on an interval between the edge pixels in an X direction or a Y direction (see, S002 of FIG. 8). Here, the printer driver determines the line width as 9 pixels based on the interval between the edge pixels indicated by the thick frame of FIG. 9B. In addition, when the intervals between the edge pixels in the X direction (horizontal direction in FIG. 9B) and the Y direction (vertical direction in FIG. 9B) are different, the line width is determined based on the narrower interval. This is because the line width is incorrectly determined when determining the line width based on the wider interval, for example, in a case in which the image is a laterally long line.

Next, the printer driver determines the conversion width, the convex portion width, and the concave portion width based on the line width (see, S003 of FIG. 8). In the above described inspection process, the table that associates the line width with each of the conversion width, the convex portion width, and the concave portion width is stored in the computer 110, so that the printer driver determines the conversion width, the convex portion width, and the concave portion width based on the table. Here, it is assumed that all of the conversion width, the convex portion width, and the concave portion width are determined as "1 pixel".

Next, the printer driver determines a conversion target region in accordance with the determined conversion width (see, S004 of FIG. 8). Here, since the conversion width is 1 pixel, a region indicated by a thick frame of FIG. 9C is the conversion target region. In addition, here, since image data is processed so that a dot is formed in a pixel that does not originally form a dot (in the case of a dot addition process), the conversion target region is set in the outside of the edge pixel. When the image data is processed so that a dot is not formed in a pixel that originally forms a dot (in the case of a dot reduction process), an inner side including the edge pixel is set as the conversion target region.

Next, the printer driver specifies the conversion target pixel based on the convex portion width and the concave portion width from among pixels included in the conversion target region (see, S005 of FIG. 8). Here, since both the convex portion width and the concave portion width are 1 pixel, the pixel included in the conversion target region becomes a conversion target pixel for each 1 pixel along the edge.

Next, the printer driver converts pixel data of the conversion target pixel from "0" to "1" (see, S006 of FIG. 8). Consequently, the printer driver converts pixel data "0" indicating that a dot is not formed into pixel data "1" indicating that a dot is formed. Here, the pixel data of the conversion target pixel indicated by a thick frame of FIG. 9D is converted from "0" to "1".

The computer 110 adds control data to pixel data of gradations after performing the "roughening process" to thereby generate print data, and transmits the print data to the printer 1 (see, FIG. 7). The printer 1 ejects UV ink from each nozzle of the head unit 30 in accordance with each pixel data while controlling each unit in accordance with the control data included in the print data, and prints an image on a medium.

The printer 1 ejects the UV ink from each nozzle of the head unit in accordance with pixel data, and forms a dot on the medium in accordance with the pixel data shown in FIG. 9D. Thus, the printer 1 forms fine unevenness in the original edge of the image by alternately having a pixel that forms a dot and a pixel that does not form the dot along the original edge of the image.

A dot is not formed in a pixel of a concave portion; however, the UV ink gets wet and spreads from an adjacent region (a region of a convex portion or a region inside the conversion target region) before the UV ink is irradiated with ultraviolet rays to be cured, so that a width of the concave portion becomes narrower. Thus, unevenness is relaxed on a filled image substantially printed on the medium rather than the concave portion width on the image data, so that it is difficult to visually perceive the unevenness.

Next, the printer 1 irradiates an image with ultraviolet rays from the initial curing irradiation unit 41 and the main curing irradiation unit 42. Thus, the image formed of the UV ink is cured, and the print image is settled on the medium.

According to the present embodiment, the fine unevenness is formed in the original edge of the image, so that a ridge line of the thickest portion due to the "thick heap phenomenon" is formed like rippling. As a result, even though a part close to the edge of the print image is shining, the shining part is distorted, thereby suppressing the "thick heap perception".

Other Embodiments

Another "roughening process" 1 (in the case in which pixel data is 2 bits)

In the above described embodiment, by additionally forming the same dot as that to be formed in an original filled region in the outside of the filled region, the unevenness is formed in the edge of the filled region. However, the present embodiment is not limited thereto.

FIG. 10A is an explanatory diagram of image data obtained after performing a halftone process. Here, the image data obtained after performing the halftone process is 2-bit data which is different from 1-bit data. When pixel data of 2 bits is "00", this indicates that a dot is not formed, when the pixel data of 2 bits is "01", this indicates that a small dot is formed, when the pixel data of 2 bits is "10", this indicates that an intermediate dot is formed, and when the pixel data of 2 bits is "11", this indicates that a large dot is formed.

FIG. 10B is an explanatory diagram of image data obtained after performing a "roughening process". Here, pixel data of a conversion target pixel indicated by a thick frame is converted from "00 (no-forming dot)" to "01 (small dot)". That is, the pixel data is converted so that the large dot is formed in the filled region, and the small dot is formed in the outside of the filled region.

Even in the "roughening process" described as above, the fine unevenness is formed in the original edge of the image, so that the ridge line of the thickest portion due to the "thick heap phenomenon" may be formed like rippling. As a result, even though a part close to the edge of the print image is shinning, the shining part is distorted, thereby suppressing the "thick heap perception".

Another "roughening process" 2 ("roughening process" before performing a halftone process)

In the above described embodiment, the "roughening process" is performed with respect to the image data after performing the halftone process. In other words, the "roughening process" is performed with respect to the image data indicating a dot-formation state. However, the present embodiment is not limited thereto.

Figure 11:
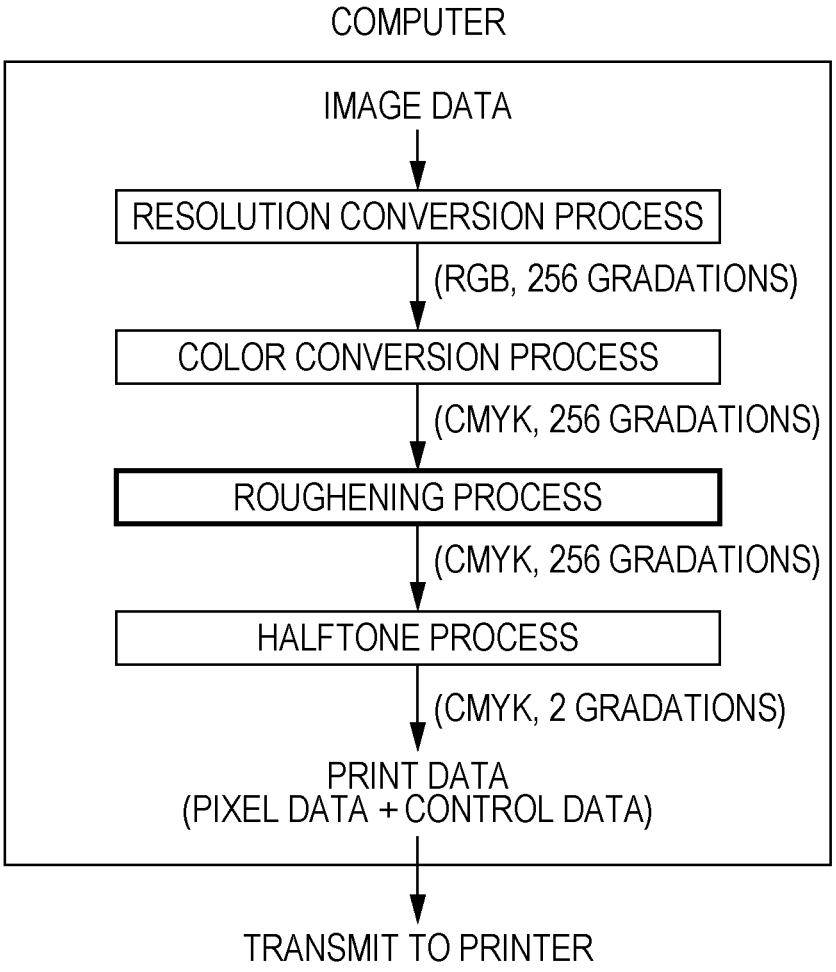
FIG. 11 is an explanatory diagram of another process of a printer driver.

FIG. 11 is an explanatory diagram of another process of a printer driver. As shown in FIG. 11, a "roughening process" is performed immediately after performing a color conversion process and before performing a halftone process.

FIG. 12A is an explanatory diagram of image data before performing a halftone process. Since the image data is image data after performing the color conversion process, image data of 8 bits indicating 256 gradations corresponds to each pixel. Here, a white color is indicated when pixel data is "0", and a black color is indicated when the pixel data is "255", so that a darker gray color is indicated along with an increase in the value of the pixel data.

FIG. 12B is an explanatory diagram of image data after performing a "roughening process". Here, pixel data of a conversion target region indicated by a thick frame is converted from "0 (white)" to "63 (light gray)" or "127 (dark gray)". In this manner, the conversion target pixel may be converted into different pixel data.

In addition, the pixel data is converted to a gradation value of a high density toward an image, and the pixel data is converted to a gradation value of a low density toward the outside of the image. In other words, a gradation is formed to be gradually lighter toward the outside of the image. This is because a dot density is increased toward the image which will be described later.

A halftone process is performed with respect to the above described image data after performing the "roughening process".

FIG. 12C is an explanatory diagram of image data after performing the halftone process. As a value of pixel data before performing the halftone process is larger (as a gradation value of a high density is indicated), a probability that pixel data after performing the halftone process is "1" becomes higher. In addition, as the value of the pixel data before performing the halftone process is smaller (as a gradation value of a low density is indicated), a probability that pixel data after performing the halftone process is "0" becomes higher. Thus, toward an inner side of the conversion target region, pixel data of indicating dot-formation is increased.

When the printer 1 prints an image in accordance with image data of FIG. 12C, a pixel that forms a dot along an original edge of an image, and a pixel that does not form a dot along the original edge of the image are alternately appeared, thereby forming fine unevenness in the edge.

In particular, according to the present embodiment, the dot density is increased toward an image, and the dot density is reduced toward the outside of the image. Therefore, ink coated in an inner side of an image easily flows to the outside of the image, so that the ridge line of the thickest portion due to the "thick heap phenomenon" is greatly rippling, thereby more suppressing the "thick heap perception". When a dot density of a region close to the image is small, and the dot density is increased toward the outside of the image, the ink coated in the inner side of the image hardly flows to the outside (as a result, the ridge line of the thickest portion due to the thick heap phenomenon is less rippling, so that the suppression effect of the "thick heap perception" may be reduced).

Another Test Pattern

In the above described embodiment, the rectangular pattern is formed; however, the present embodiment is not limited thereto.

FIG. 13 is an explanatory diagram of another test pattern. In the present embodiment, a character image is printed as the filled image, instead of the rectangular pattern. Thus, in the inspection process, the character image is printed on the medium, and the "thick heap perception" of the printed character image or image quality thereof is evaluated, so that the optimized conversion width, convex portion width, and concave portion width may be determined. In addition, it is preferable that a plurality of test patterns having different character sizes is formed even when forming the test pattern using the character image, in the same way that a plurality of test patterns having different line widths is formed in the above described test pattern. In this case, a table that associates each of the conversion width, the convex portion width, and the concave portion width with each character size is stored.

Other Embodiments

The above described embodiments are intended to facilitate understanding of the invention, and are not intended to be construed as limiting the invention. The invention can be modified and improved not departing from the sprit of the invention, and at the same time, equivalents thereof will be included in the invention.

Filled Image

A filled image on image data before the above described "roughening process" is an image in which a dot is formed in all pixels. However, the invention is not limited thereto. The filled image may be an image in which a predetermined region of a medium is painted out using ink, and may be an image including a pixel in which a dot is not formed in a part.

Line Printer

The printer 1 described as above is a so-called line printer. In the printer 1, a medium is transported to a fixed head, and a dot row is formed in a transportation direction on the medium. However, the printer 1 is not limited to the line printer. For example, a printer in which a head is provided in a carriage movable in a main scanning direction, and a printer (so-called a serial printer) in which a dot formation operation of forming dots in the main scanning direction by ejecting UV ink from a moving head and a transportation operation of transporting a medium are alternatively repeated may be used.

In the case of the serial printer, it is possible to form a dot row at an interval narrower than a nozzle pitch. That is, it is possible to increase a printing resolution higher than that of the nozzle pitch. Therefore, a resolution of the above described image data may not be the same resolution as that of the nozzle pitch, and may be higher than that of the nozzle pitch.

Process of Computer 110

The above described computer 110 performs a resolution conversion process, a color conversion process, a halftone process, a "roughening process", and the like. A part or all of these processes may be performed in the printer 1 side. When the "roughening process" performed by the computer 110 is performed at the printer side instead, the printer 1 may print, on the medium, an image on which the "roughening process" has been performed, so that the printer 1 alone corresponds to the "printing apparatus".

What is claimed is:

1. A printing apparatus, comprising:

a nozzle that ejects, to a medium, photo-curing ink which is cured when irradiated with light;

an irradiation unit that irradiates the photo-curing ink landed on the medium with light;

a controller which controls the nozzle and the irradiation unit to form an image on the medium based on image data, wherein, when printing an image on the medium using the photo-curing ink, the controller determines the line width of the image based on edge pixels, the controller converts pixel data in the conversion target region based on the table and the line width of the image, and the controller controls the nozzle to eject the photo curing ink in accordance with the converted pixel data.

2. The printing apparatus according to claim 1, wherein the converted pixel data is formed so that a dot density is increased toward the image.

3. The printing apparatus according to claim 1, wherein a test pattern is printed on the medium, and formation of the converted pixel data is determined in accordance with a test result of the test pattern.

4. The printing apparatus according to claim 1, wherein the image is printed on the medium that does not have an ink receiving layer.

5. A printing method which uses a nozzle that ejects, to a medium, photo-curing ink which is cured when irradiated with light, an irradiation unit that irradiates the photo-curing ink landed on the medium with light; a controller which controls the nozzle and the irradiation unit form an image on the medium based on image data; and a memory that stores a table which associates a line width of the image with each of a conversion target region, first pixels of the conversion target which form a dot, and second pixels of a conversion target region which do not form the dot, the printing method comprising:

when printing an image on the medium using the photo-curing ink, performing an edge extraction process with respect to the image data using the controller to extract edge pixels located in a border of the image, the controller determining a line width of the image based on the edge pixels;

converting pixel data of a conversion target region based on the table and the line width of the image using the controller; and controlling the nozzle to eject the photo curing ink in accordance with the converted pixel data.

6. A non-transitory computer-readable storage medium storing a program executed in a printing apparatus including a nozzle that ejects, to a medium, photo-curing ink which is cured when irradiated with light; an irradiation unit that irradiates the photo-curing ink landed on the medium with light; a controller which controls the nozzle and the irradiation unit form an image on the medium based on image data; and a memory that stores a table which associates a line width of the image with each of a conversion target region, first pixels of the conversion target which form a dot, and second pixels of the conversion target region which do not form a dot, the program comprising:

performing an edge extraction process with respect to the image data to thereby extract edge pixels located in a border of the image;

determining a line width of the image based on the edge pixels, converting pixel data of a conversion target region based on the table and the line width of the image, controlling the nozzle to eject the photo-curing ink in accordance with the converted pixel data using the controller.

* * * * *